US011597231B2

(12) United States Patent
Roudaut et al.

(10) Patent No.: US 11,597,231 B2
(45) Date of Patent: Mar. 7, 2023

(54) NIB FOR WRITING FELT PEN

(71) Applicant: SOCIETE BIC, Clichy (FR)

(72) Inventors: Etienne Roudaut, Clichy (FR); Arnaud Bez, Clichy (FR)

(73) Assignee: SOCIÉTÉ BIC, Clichy (FR)

( * ) Notice: Subject to any disclaimer, the term of this patent is extended or adjusted under 35 U.S.C. 154(b) by 168 days.

(21) Appl. No.: 17/083,183

(22) Filed: Oct. 28, 2020

(65) Prior Publication Data

US 2021/0122181 A1 Apr. 29, 2021

(30) Foreign Application Priority Data

Oct. 29, 2019 (EP) ..... 19306404

(51) Int. Cl.
*B43K 1/00* (2006.01)
*B43K 5/02* (2006.01)

(52) U.S. Cl.
CPC ..... *B43K 1/006* (2013.01); *B43K 5/02* (2013.01)

(58) Field of Classification Search
CPC ..... B43K 1/003; B43K 1/006; B43K 1/12; B43K 8/02; B43K 8/03; B43K 5/18
See application file for complete search history.

(56) References Cited

U.S. PATENT DOCUMENTS 3,609,052 A 9/1971 Airosus
4,221,493 A 9/1980 Cole et al.
4,710,331 A * 12/1987 Nobuo ..... C08J 5/18 264/41
4,838,723 A * 6/1989 Suzuki ..... B43K 1/12 401/265
5,290,116 A * 3/1994 Chang ..... B43K 7/105 401/199
7,481,593 B2 * 1/2009 Kwan ..... A46B 11/0041 401/270

(Continued)

FOREIGN PATENT DOCUMENTS

CA 2011485 A1 * 12/1990
EP 0091516 A1 10/1983

(Continued)

OTHER PUBLICATIONS

Extended European Search Report dated Apr. 29, 2020 in counterpart European Patent Application No. 19306404.5 (7 pages, in English).

*Primary Examiner* — David P Angwin
*Assistant Examiner* — Bradley S Oliver
(74) *Attorney, Agent, or Firm* — Bookoff McAndrews, PLLC

(57) ABSTRACT

A nib for a valve-free free ink writing felt pen including a first end configured to deliver ink to a writing support and second end, opposite the first end, configured to be inserted in a nib receiving part of the valve-free free ink writing felt pen, the first end and the second end defining an axial direction of the nib, the nib including a main body made of porous hydrophilic material and including one or more insert made of porous hydrophobic material, the one or more insert being configured to allow intake of air from the outside of a free ink tank of the valve-free free ink writing felt pen into the free ink tank and avoid ink leakage outside the free ink tank. A valve-free free ink writing felt pen including a nib.

20 Claims, 4 Drawing Sheets

(56) References Cited

U.S. PATENT DOCUMENTS

| | | | | |
|---|---|---|---|---|
| 8,177,448 | B2 * | 5/2012 | Rolion | B43K 8/003 401/199 |
| 10,336,129 | B2 * | 7/2019 | Nakajima | B43K 17/005 |
| 2013/0046040 | A1 * | 2/2013 | Srinivasan | C08J 9/24 526/159 |

FOREIGN PATENT DOCUMENTS

| | | | |
|---|---|---|---|
| GB | 2249948 | A | 5/1992 |
| JP | H11129672 | A | 5/1999 |
| WO | 98/17482 | A1 | 4/1998 |

* cited by examiner

NIB FOR WRITING FELT PEN

CROSS REFERENCE TO RELATED APPLICATION(S)

This application claims priority to European patent application No. EP19306404.5 filed on Oct. 29, 2019, the entire contents of which is incorporated herein by reference.

TECHNICAL FIELD

The present disclosure is related to valve-free free ink writing felt pen, and more particularly to a nib for a valve-free free ink writing felt pen.

BACKGROUND

A free ink writing felt pen is felt pen in which the ink is free to move in the ink tank. In free ink writing felt pen, ink used for writing has to be replaced by air in the ink tank.

Baffles are known, which are made of a succession of lamellas. Baffles allow the ink to flow without leaking and air exchange to ensure air balance between the inside of ink tank and the atmosphere outside the ink tank. As the afore-mentioned air balance is maintained by the baffles, there is no need for an air hole being present in the writing instrument.

Free ink writing felt pen with valves controlling the flow of ink are also known.

However, it might remain desirable to increase the autonomy of the free ink writing felt pen and simplifying its production, while avoiding leakage of ink and ensuring good flow of ink outside of the ink tank when writing with the free ink writing felt pen.

SUMMARY

Therefore, according to embodiments of the present disclosure, a nib for a valve-free free ink writing felt pen is provided. A valve-free free ink writing felt pen is defined as a felt pen in which the nib itself acts as a baffle. This eliminates the use of traditional baffles (as described in the above section), making the felt pen more reliable and/or less complex to manufacture. The nib may include a first end configured to deliver ink to a writing support and second end, opposite the first end, configured to be inserted in a nib receiving part of the valve-free free ink writing felt pen, the first end and the second end defining an axial direction of the nib, the nib including a main body being made of porous hydrophilic material and including one or more insert made of porous hydrophobic material, the one or more insert being configured to allow intake of air from the outside of a free ink tank of the valve-free free ink writing felt pen into the free ink tank and avoid ink leakage outside the free ink tank.

The one or more insert may be configured to be in part in contact with an internal surface of the nib receiving part when the nib is received in the nib receiving part.

The one or more insert may have a ring shape.

The nib may include an open cavity having an opening, the opening of the cavity being configured to face the free ink tank when the nib is received in the nib receiving part, the one or more insert being disposed in the open cavity.

The one or more insert may be made of sintered particles.

The one or more insert may include polytetrafluoroethylene or silicon, or a mixture thereof.

The one or more insert may include a hydrophilic material with a hydrophobic local treatment. More specifically, the hydrophobic local treatment may comprise of applying a hydrophobic (i.e. water/liquid repelling) layer to the insert, for example by using particle deposition, sol-gel techniques, plasma treatments, vapor deposition, casting techniques or any other commercially available method.

The one or more insert may be made of polyethylene with silicon coating or paraffin coating.

The one or more insert may be a part distinct from the main body of the nib or a part of the main body of the nib that is coated.

The nib may include an abutment surface configured to cooperate with an abutment element of the nib receiving part when the nib is received in the nib receiving part.

The nib may be a sintered powder nib.

The sintered powder nib may include polypropylene or polyethylene, or a mixture thereof.

The nib may include fibers agglomerated by a resin.

The fibers may include polyester, acrylic, polyamide or polyacrylonitrile, or a mixture thereof and the resin may comprise polyurethane or urea aminoplast, or a mixture thereof.

The nib may be an extruded nib.

The extruded nib may include polyacetal, polypropylene or polyethylene, or a mixture thereof.

Therefore, according to embodiments of the present disclosure, a valve-free free ink writing felt pen is provided. The valve-free free ink writing felt pen may include a free ink tank, a nib receiving part and an above-defined nib.

The nib receiving part may include one or more axial abutment element of the nib into the nib receiving part.

It is intended that combinations of the above-described elements and those within the specification may be made, except where otherwise contradictory.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

DETAILED DESCRIPTION

Reference will now be made in detail to exemplary embodiments of the disclosure, examples of which are illustrated in the accompanying drawings. Wherever possible, the same reference numbers will be used throughout the drawings to refer to the same or like parts.

Figure 1:
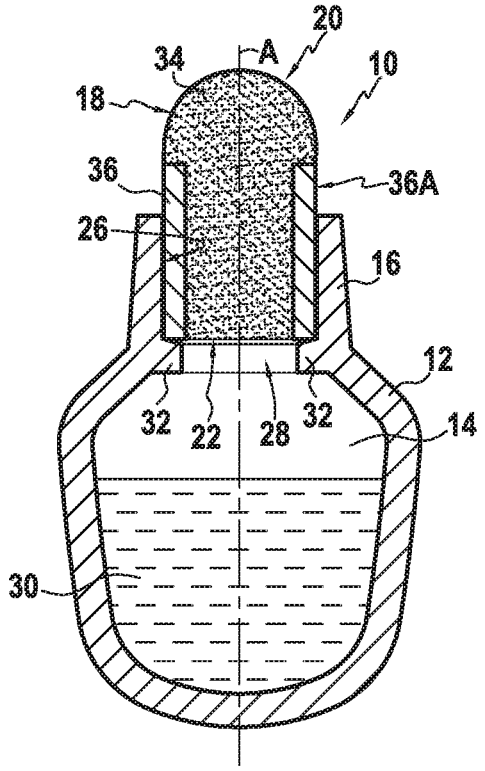
FIG. 1 shows a representation of an exemplary a valve-free free ink writing felt pen.

FIG. 1 shows a representation of an exemplary valve-free free ink writing felt pen 10 according to embodiments of the present disclosure. The valve-free free ink writing felt pen 10 may include a body 12. The body 12 may include a free ink tank 14 and a nib receiving part 16. The valve-free free ink writing felt pen 10 may include a nib 18. The nib 18 may include a first end 20 configured to deliver ink to a writing support and second end 22, opposite the first end 20. The second end 22 may be inserted in the nib receiving part 16 of the valve-free free ink writing felt pen 10.

As shown on FIG. 1, the first end 20 and the second end 22 may define an axial direction A of the nib 18. The axial direction A is also the axial direction of the valve-free free ink writing felt pen 10.

As shown on FIG. 1, the free ink tank 14 may include free ink 30.

The body 12 may also include a feeding passage 28 allowing the free ink 30 to flow from the free ink tank 14 to the second end 22 of the nib 18 and through the nib 18 to the first end 20 of the nib 18 and to a writing support.

The nib receiving part 16 may include an axial abutment element 32 of the nib 18 into the nib receiving part 16. The axial abutment element 32 allows limiting the insertion along the axial direction A of the nib 18 into the nib receiving part 16.

As shown on FIG. 1 and as a non-limiting example, the axial abutment element 32 may be circumferential, i.e., be continuous in a circumferential direction and have a general annular shape.

Alternatively, as shown on FIG. 1 and as a non-limiting example, the nib receiving part 16 may include more than one axial abutment element 32 of the nib 18 into the nib receiving part 16, in particular an even number of abutment elements 32, for example four, disposed at regular interval, the view of FIG. 1 cutting through two opposed axial abutment elements 32.

As a non-limiting example, the free ink 30 may be a water-based free ink and the nib may be made of a hydrophilic material.

As shown on FIG. 1, the nib 18 may include a main body 34 made of porous hydrophilic material and may include one insert 36 made of porous hydrophobic material. The insert 36 may be configured to allow intake of air from the outside of the free ink tank 14 of the valve-free free ink writing felt pen 10 into the free ink tank 14 and avoid ink leakage outside the free ink tank 14.

The porous hydrophilic material allows for the free ink 30 to flow from the free ink tank 14 towards the first end 20 of the nib 18 and the porous hydrophobic material allows intake of air from the outside of the free ink tank 14 of the valve-free free ink writing felt pen 10 into the free ink tank 14 and avoid ink leakage outside the free ink tank 14.

Figure 3:
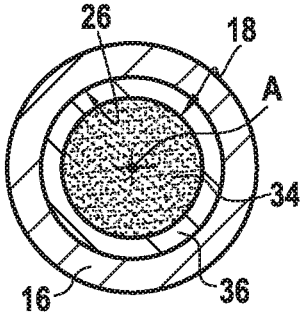
FIG. 3 shows a cross-section along plan III-III of FIG. 2.

As a non-limiting example, as shown on FIGS. 1 and 3, the insert 36 may have a ring shape and the insert 36 may be in part in contact with an internal surface 26 of the nib receiving part 16, i.e., the insert 36 may have a portion that may present an external surface is not in contact with the internal surface 26 of the nib receiving part 16 and not inside the body 12 of the valve-free free ink writing felt pen 10, referred hereafter as the free surface 36A.

Air may thus pass from the outside of the valve-free free ink writing felt pen 10 into the free ink tank 14 through the free surface 36A and through the insert 36.

When the axial abutment element 32 is circumferential, the axial abutment element 32 may present a slope allowing passage of air between the insert 36 and the axial abutment element 32.

As a non-limiting example, the axial abutment element 32 is circumferential, the second end 22 of the nib 18 may present a slope allowing passage of air between the insert 36 and the axial abutment element 32.

As non-limiting examples, the nib 18 may be inserted in the nib receiving part 16 and be held in place by press-fitting, welding, gluing, snap fitting, screwing.

Figure 2:
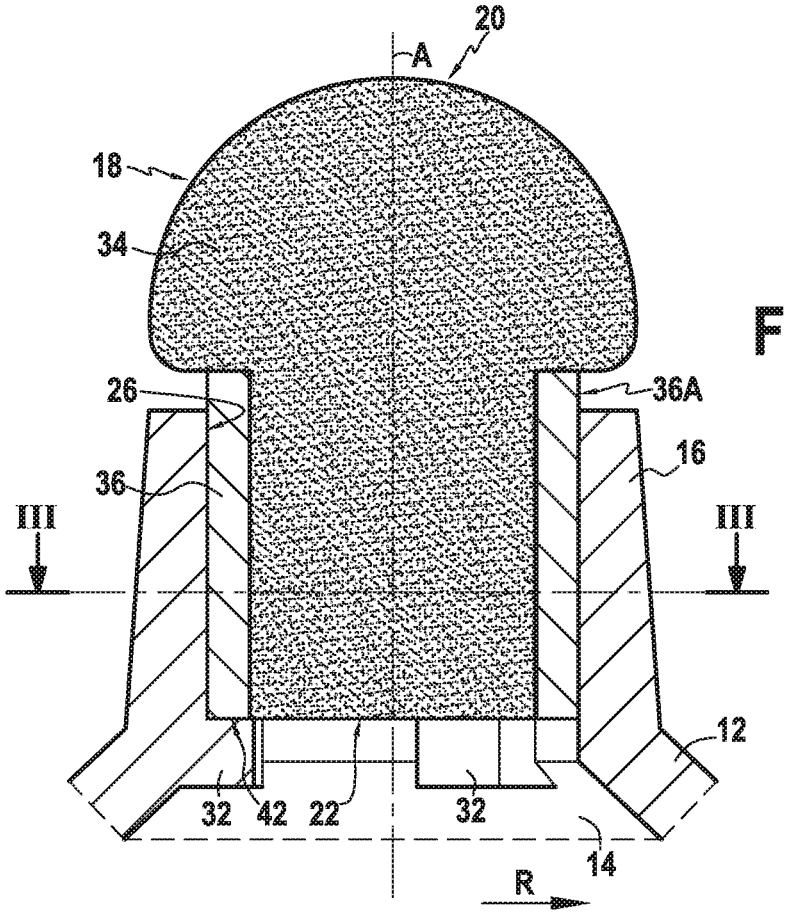
FIG. 2 shows an enlarged partial view of another exemplary valve-free free ink writing felt pen.

As shown on FIG. 2, the nib receiving part 16 may include more than one axial abutment element 32 of the nib 18 into the nib receiving part 16. As a non-limiting example, the nib receiving part 16 may include three axial abutment elements 32. The three axial abutment elements 32 cooperates with abutments surfaces 42 of the nib 18 to limit the insertion along the axial direction A of the nib 18 into the nib receiving part 16.

Figure 4:
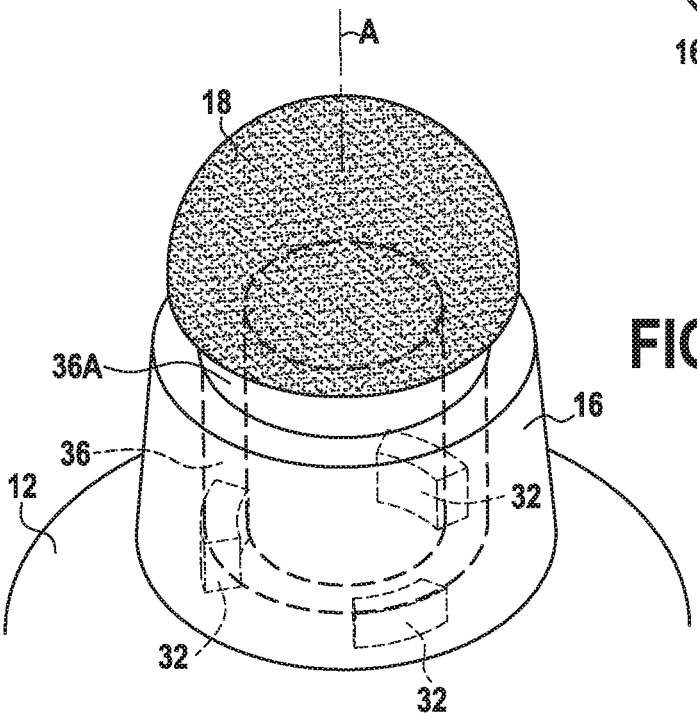
FIG. 4 shows a partial perspective view of the exemplary valve-free free ink witting felt pen of FIG. 2

FIG. 4 is a partial perspective view of FIG. 2. For better comprehension, in FIG. 4, elements have been represented in transparency thus showing the three axial abutment elements 32. It is understood that the number of axial abutment elements is not limited to the examples shown on FIGS. 1, 2-4.

FIG. 3 is a cross-along plan III-III of FIG. 2 and shows that the insert 36 may have a ring shape.

The insert 36 may be a part distinct from the main body 34 of the nib 18 or a part of the main body 34 of the nib 18 that is coated.

As non-limiting examples, the nib 18 may be made by overmolding the insert 36 on the main body 34 of the nib 18, by tight fitting of the insert 36 on the main body 34 of the nib 18, by gluing the insert 36 on the main body 34 of the nib 18, by friction welding of the insert 36 on the main body 34 of the nib 18.

As non-limiting example, the insert 36 may be obtained by local treatment of the main body 34 of the nib 18 so as to obtain the hydrophobic insert 36. The local treatment may be carried out after a molding step. The local treatment may be carried out with cover tool applied only on selected area of the main body 34 of the nib 18.

Figure 5:
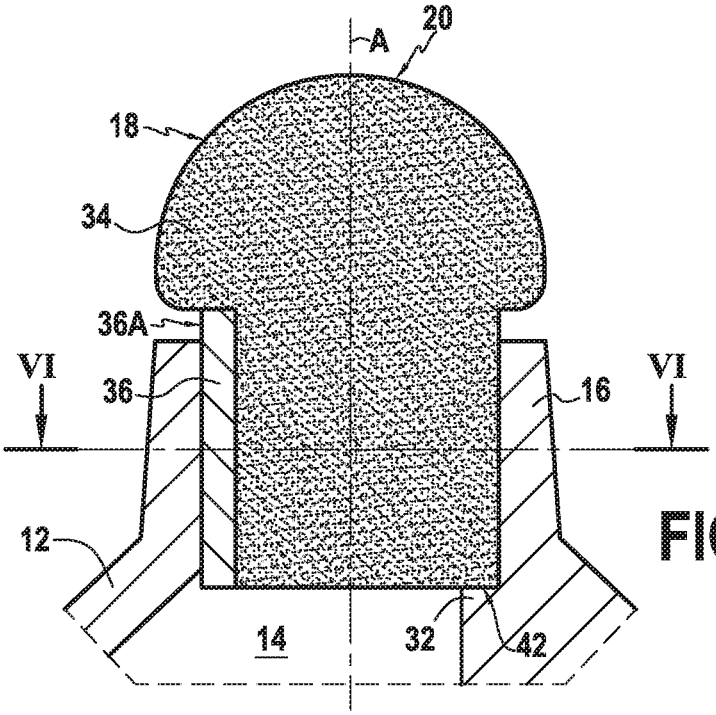
FIG. 5 shows an enlarged partial view of another exemplary valve-free free ink writing felt pen.
Figure 6:
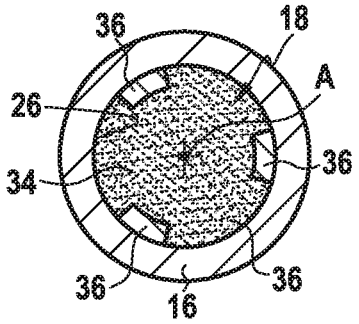
FIG. 6 shows a cross-section along plan VI-VI of FIG. 5.

As shown in FIGS. 5 and 6, the nib 18 may include more than one insert 36, as a non-limiting example, the nib 18 may include three inserts 36. Each insert 36 may be in part in contact with the internal surface 26 of the nib receiving part 16, i.e., the insert 36 may have a portion that may present an external surface is not in contact with the internal surface 26 of the nib receiving part 16 and not inside the body 12 of the valve-free free ink writing felt pen 10, referred hereafter as the free surface 36A.

As shown in FIG. 6, the three inserts 36 may be disposed at 120° of each other.

As shown in FIG. 5, the axial abutment element 32 may preferably be disposed where no insert 36 is present.

The nib 18 and/or the nib receiving part 16 may include foolproof element(s) to allow non-alignment of the axial abutment elements 32 and the inserts 36.

The second end 22 of the nib 18 and the axial abutment elements 32 may each present a slope allowing passage of air between the insert 36 and the axial abutment element 32, i.e., the slope of the second end of the nib 18 is different from the slope of the axial abutment elements 32.

The number of axial abutment elements 32 may be different from the number of inserts 36.

Figure 7:
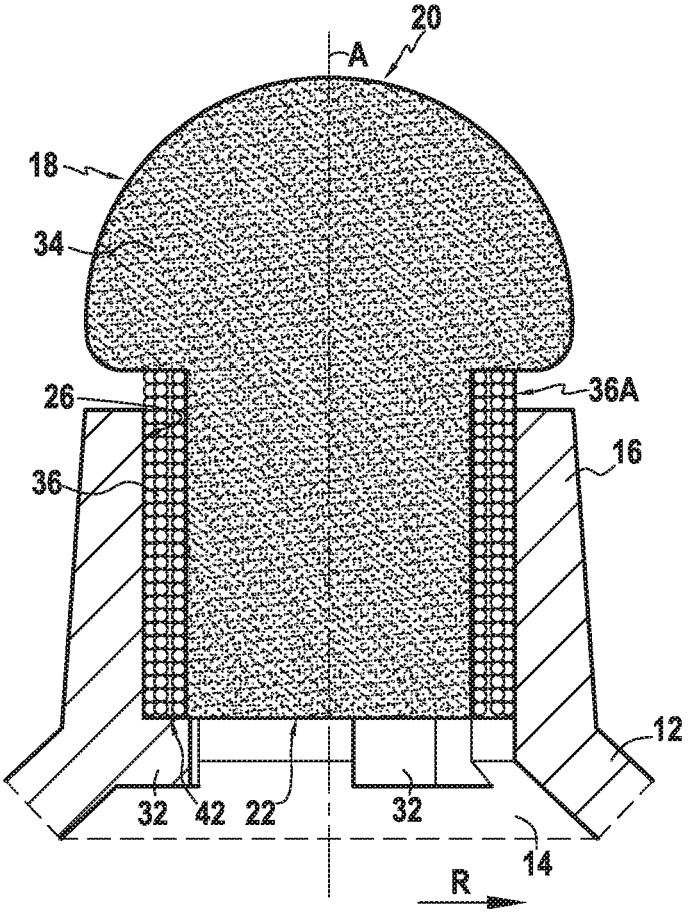
FIGS. 7-9 show enlarged partial views of other exemplary valve-free free ink witting felt pens.

As shown in FIG. 7, the insert 36 may be made of sintered particles.

As a non-limiting example, the insert 36 of FIG. 7 may have a ring shape.

Figure 8:
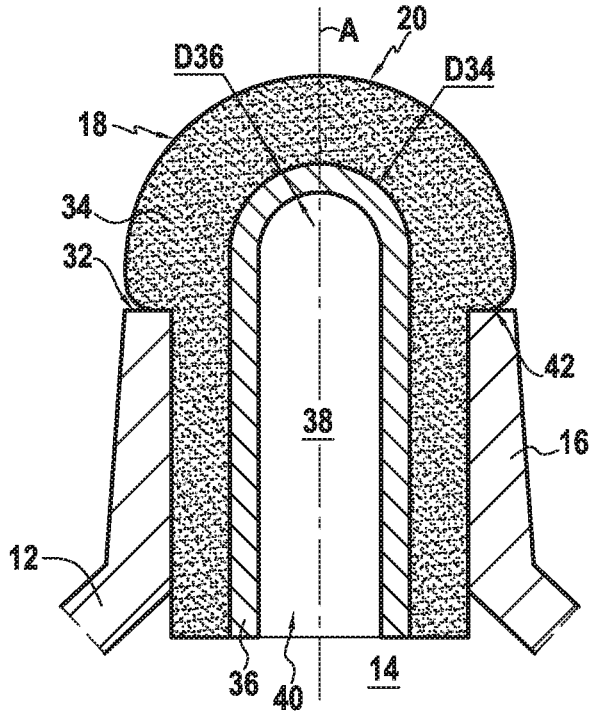

As shown in FIG. 8, the nib 18 may include an open cavity 38 having an opening 40, the opening 40 of the cavity being configured to face the free ink tank 14 when the nib 18 is received in the nib receiving part 16.

As shown in FIG. 8, the insert 36 may be disposed in the open cavity 38. In FIG. 8, the insert 36 is continuous. However, there may be a plurality of inserts 36 disposed in the open cavity 38.

The insert 36 may have a thickness D36 and the body 34 of the nib 18 may have a thickness D34, measured in the main body 34 part of the nib 18 that is not inserted in the nib receiving part 16. The ratio D36/D34 is then measured and the maximum value of D36/D34 by be between 1:3 and 3:1.

As shown in FIG. 8, the nib 18 may include an abutment surface 42 cooperating with an abutment element 32 of the nib receiving part 32 to limit the insertion along the axial direction A of the nib 18 into the nib receiving part 16.

Although the body 34 of the nib 18 is made of hydrophilic material, tanks to the ratio of the thickness D36 of the insert 36 to the thickness D34 of the body 34 of the nib 18, the air may pass from the outside of the valve-free free ink writing felt pen 10 into the free ink tank 14 through the body 34 of the nib 18 and the insert 36.

Figure 9:
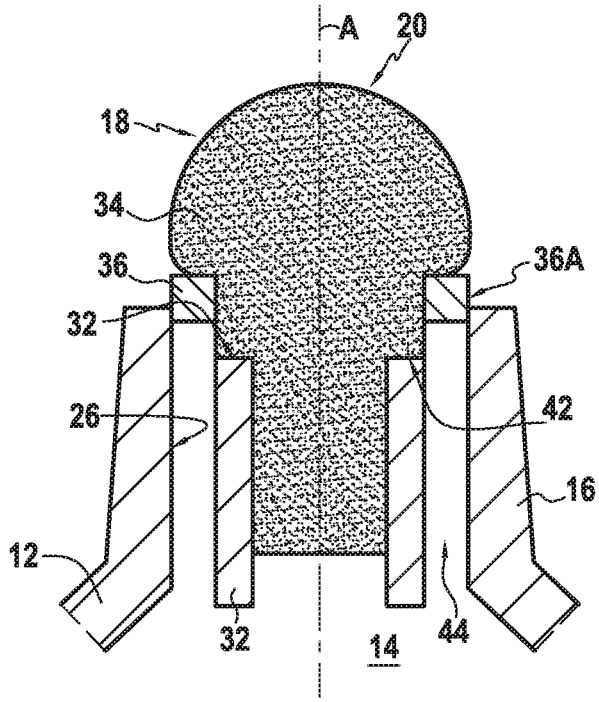

The embodiment of FIG. 9 is similar to the embodiments of FIG. 1-8. As shown in FIG. 9, the axial abutment elements 32 may cooperate with an abutment surface 42 of the nib 18. The axial abutment element 32 may be attached to the nib receiving part 16 by internal longitudinal ribs (not shown). There may be an annular space 44 between the axial abutment element 32 and the internal surface 26 of the nib receiving part 16. The insert 36 may not be present on the full part of the main body 34 of the nib 18 that is inserted into the nib receiving part 16 so as to have a short path for the air intake through the insert 36.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A nib for a valve-free free ink writing felt pen comprising a first end configured to deliver ink to a writing support and second end, opposite the first end, configured to be inserted in a nib receiving part of the valve-free free ink writing felt pen, the first end and the second end defining an axial direction of the nib, the nib comprising a main body made of porous hydrophilic material and comprising one or more insert made of porous hydrophobic material, the one or more insert being configured to allow intake of air from the outside of a free ink tank of the valve-free free ink writing felt pen into the free ink tank and avoid ink leakage outside the free ink tank, wherein the nib comprises an open cavity having an opening, the opening of the cavity being configured to face the free ink tank when the nib is received in the nib receiving part, the one or more insert being disposed in the open cavity.

2. The nib according to claim 1, wherein the one or more insert is configured to be in part in contact with an internal surface of the nib receiving part when the nib is received in the nib receiving part.

3. The nib according to claim 2, wherein the one or more insert has a ring shape.

4. The nib according to claim 1, wherein the one or more insert is made of sintered particles.

5. The nib according to claim 1, wherein the one or more insert comprises polytetrafluoroethylene or silicon.

6. The nib according to claim 1, wherein the one or more insert comprises a hydrophilic material with a hydrophobic local treatment.

7. The nib according to claim 1, wherein the nib comprises an abutment surface configured to cooperate with an abutment element of the nib receiving part when the nib is received in the nib receiving part.

8. The nib according to claim 1, wherein the nib is a sintered powder nib.

9. The nib according to claim 8, wherein the sintered powder nib comprises polypropylene or polyethylene.

10. The nib according to claim 1, wherein the nib comprises fibers agglomerated by a resin.

11. The nib according to claim 10, wherein the fibers comprise polyester, acrylic, polyamide or polyacrylonitrile and the resin comprises polyurethane or urea aminoplast.

12. The nib according to claim 1, wherein the nib is an extruded nib.

13. The nib according to claim 12, wherein the extruded nib comprises polyacetal, polypropylene or polyethylene.

14. A valve-free free ink writing felt pen comprising a free ink tank, a nib receiving part and a nib according to claim 1.

15. The pen according to claim 14, wherein the nib receiving part comprises one or more axial abutment element of the nib into the nib receiving part.

16. A nib for a valve-free free ink writing felt pen to deliver ink to a writing support, the nib comprising:

a main body including porous hydrophilic material;

one or more inserts including porous hydrophobic material; and an open cavity having an opening, the opening of the cavity being configured to face a free ink tank when the nib is received in the valve-free free ink writing felt pen.

17. The nib of claim 16, wherein the one or more inserts are provided in the open cavity and are configured to allow intake of air from outside the free ink tank into the free ink tank and avoid ink leakage outside the free ink tank.

18. A nib for a valve-free free ink writing felt pen, the nib comprising:

a first end configured to deliver ink to a writing support;

a second end opposite the first end and configured to be inserted in a nib receiving part of the valve-free free ink writing felt pen;

a main body;

one or more inserts configured to allow intake of air from the outside of a free ink tank of the valve-free free ink writing felt pen into the free ink tank and avoid ink leakage outside the free ink tank; and an open cavity having an opening, the opening of the cavity being configured to face the free ink tank when the nib is received in the nib receiving part.

19. The nib of claim 18, wherein the open cavity is provided in the main body, and the one or more inserts are provided in the open cavity.

20. The nib of claim 18, wherein the main body includes a porous hydrophilic material, and the one or more inserts include porous hydrophobic material.

* * * * *